US006338325B1

(12) United States Patent
Kobayashi et al.

(10) Patent No.: US 6,338,325 B1
(45) Date of Patent: Jan. 15, 2002

(54) VALVE OPERATING MECHANISM OF AN INTERNAL COMBUSTION ENGINE

(75) Inventors: Haruki Kobayashi; Tatsuo Kanzaki; Makoto Abe; Takeshi Sassa, all of Fujisawa (JP)

(73) Assignee: Fuji Oozx, Inc., Kanagawa-ken (JP)

( * ) Notice: Subject to any disclaimer, the term of this patent is extended or adjusted under 35 U.S.C. 154(b) by 0 days.

(21) Appl. No.: 09/640,892

(22) Filed: Aug. 17, 2000

(30) Foreign Application Priority Data

Mar. 30, 2000 (JP) ..... 12-094293
Apr. 27, 2000 (JP) ..... 12-127107

(51) Int. Cl.[7] ..... F01L 3/10
(52) U.S. Cl. ..... 123/90.67; 123/188.13
(58) Field of Search ..... 123/90.67, 188.13

(56) References Cited

U.S. PATENT DOCUMENTS 4,515,346 A * 5/1985 Gaterman, III ..... 251/337
4,838,218 A * 6/1989 Sato et al. ..... 123/188.3
5,357,918 A * 10/1994 Hemmerlein et al. .... 123/90.67
5,619,961 A * 4/1997 Diggs ..... 123/188.13

FOREIGN PATENT DOCUMENTS

| | | |
|---|---|---|
| JP | 61-136106 | 8/1986 |
| JP | 63-52906 | 4/1988 |
| JP | 1-95502 | 6/1989 |
| JP | 2-87909 | 7/1990 |
| JP | 8-61026 | 3/1996 |

* cited by examiner

*Primary Examiner*—Weilun Lo

(57) ABSTRACT

To operate a poppet valve in an internal combustion engine, a valve operating mechanism comprises a valve spring retainer which has a taper bore, a pair of cotters which is inserted in the bore to support the poppet valve, and a valve spring between the valve spring retainer and a cylinder head. There is provided means for preventing the cotters from falling out the bore.

1 Claim, 5 Drawing Sheets

VALVE OPERATING MECHANISM OF AN INTERNAL COMBUSTION ENGINE

BACKGROUND OF THE INVENTION

The present invention relates to a valve operating mechanism for a poppet valve of an internal combustion engine, said mechanism comprising a spring retainer made of light alloy such as Al alloy which is mounted to the poppet valve via steel cotters, thereby increasing load of falling the cotters out of the lower end of the spring retainer.

FIG. 6 illustrates an example of a known valve operating mechanism of an internal combustion engine, in which an A1 alloy valve spring retainer 23 which has a taper bore 22 and a spring-retaining flange 23*a* is engaged with the upper end of a poppet valve 21 via a pair of steel cotters 24. An annular bead 24*a* of each of the cotters 24 is engaged in an annular groove 21*a* of the poppet valve 22 so that the valve spring retainer 23 may not come out upwards.

Between the lower surface of the spring-retaining flange 23*a* and a cylinder head (not shown), a valve spring 25 is provided, and the poppet valve 21 is always urged upwards by the valve spring retainer 23.

The numeral 26 denotes a rocker arm which is engageable on the upper end of the poppet valve 21, and is moved up and down by a rotary cam (not shown) to open and close the poppet valve 21. In the valve operating mechanism, the cotters 22 and the valve spring retainer 23 are integrally secured to the poppet valve 21 by wedge-like engagement of the cotters 24 with the bore 22. To increase securing force, taper angle of the bore is decreased, and roughness of contact surface between the bore 22 and the cotters 24 is decreased to decrease frictional resistance, thereby strengthening wedge-like engagement.

However, in a valve operating mechanism which has a relatively low mechanical strength Al alloy valve spring retainer 23, when the bore 22 is plastically deformed and expanded owing to increase in wedge-like engagement, the cotters 24 fall gradually owing to low frictional resistance of the contact surface between the bore 22 and the cotters 24. The valve spring retainer 23 moves up gradually, so that load to the valve spring 25 is decreased to decrease the maximum rotation number of surging, so that engine performance is deteriorated.

When the cotters 24 fall deeply, the lower end of the valve spring retainer 23 is liable to cause cracking and to be damaged,. so that the cotters 24 come out. To solve the problem, the valve spring retainer 23 or the lower portion thereof increases in external diameter to increase rigidity and load of the cotters 24.

However, the valve spring retainer 23 becomes larger to increase its weight. For Al alloy valve spring retainer made to lighten its weight, it will not be advantageous.

SUMMARY OF THE INVENTION

In view of the disadvantages as above, it is an object of the present invention to provide a valve operating mechanism for a poppet valve of an internal combustion engine to prevent a pair of cotters from falling out of a bore of a valve spring retainer.

BRIEF DESCRIPTION OF THE DRAWINGS

The features and advantages of the invention will become more apparent from the following description with respect to embodiment as shown in appended drawings wherein.

DETAILED DESCRIPTION OF PREFERRED EMBODIMENTS

The first embodiment of the present invention will be described.

Figure 1:
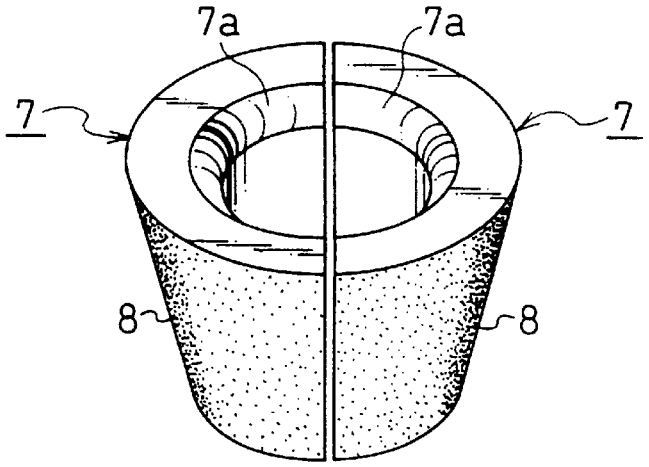
FIG. 1 is a perspective view of cotters employed in the first embodiment a valve operating mechanism of the present invention.

FIG. 1 illustrates a pair of cotters 7,7 used in a valve operating mechanism according to the present invention which have outer rough surfaces 8,8 made by sand blasting. The surfaces 8,8 may comprise uneven surfaces which have a number of sharp protrusions using rigid broken grid having sharp corners and made of cast steel.

Figure 2:
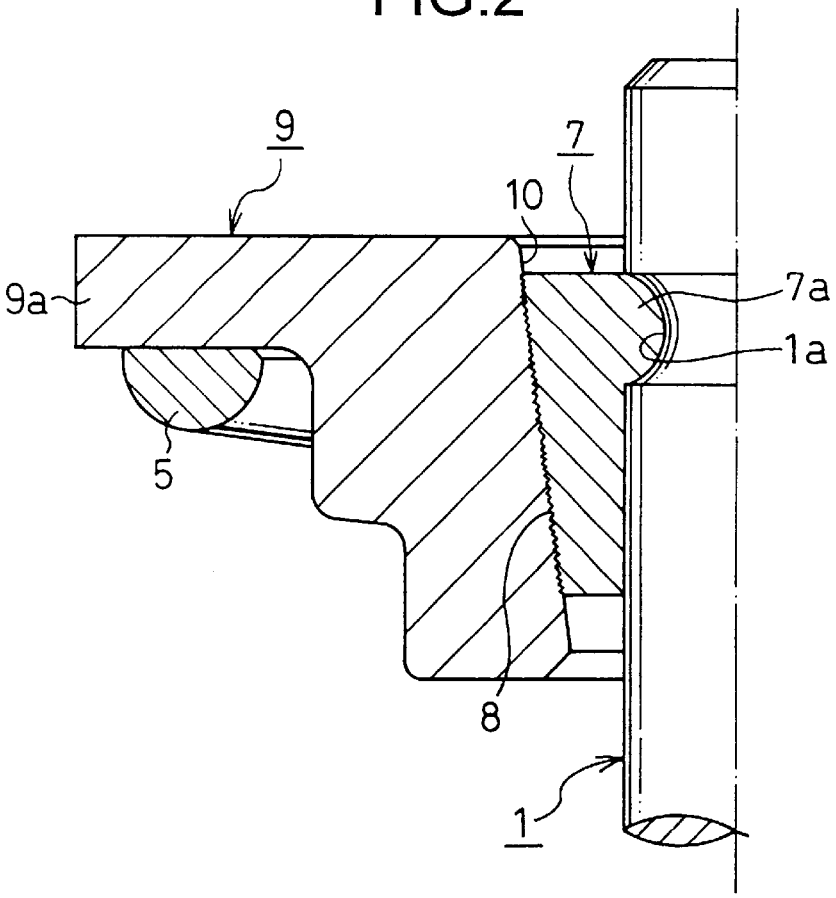
FIG. 2 is a central vertical sectional view of FIG. 1.

FIG. 2 is a sectional view of the valve operating mechanism which includes the cotter 7 which is engaged in a taper bore 10 of an Al alloy valve spring retainer 9, a bead 7*a* thereof being engaged in an annular groove 1*a* of a poppet valve 1.

In the valve operating mechanism which includes the cotter 7, load of a valve spring 5 is applied upwards to a spring-retaining flange 9*a* of the valve spring retainer 9, and the cotter 7 moves downwards in the bore 10. Then, the outer sharp protrusions of the rough surface 8 fits with the inner circumferential surface of the bore 10 to cause large frictional resistance.

The cotters 7,7 are prevented from falling, and preset load of the valve spring 5 decreases, not to decrease the maximum rotation number of surging. Cracking at the lower portion of the valve spring retainer 9 is prevented and the cotter 7 is not liable to come off.

Figure 3:
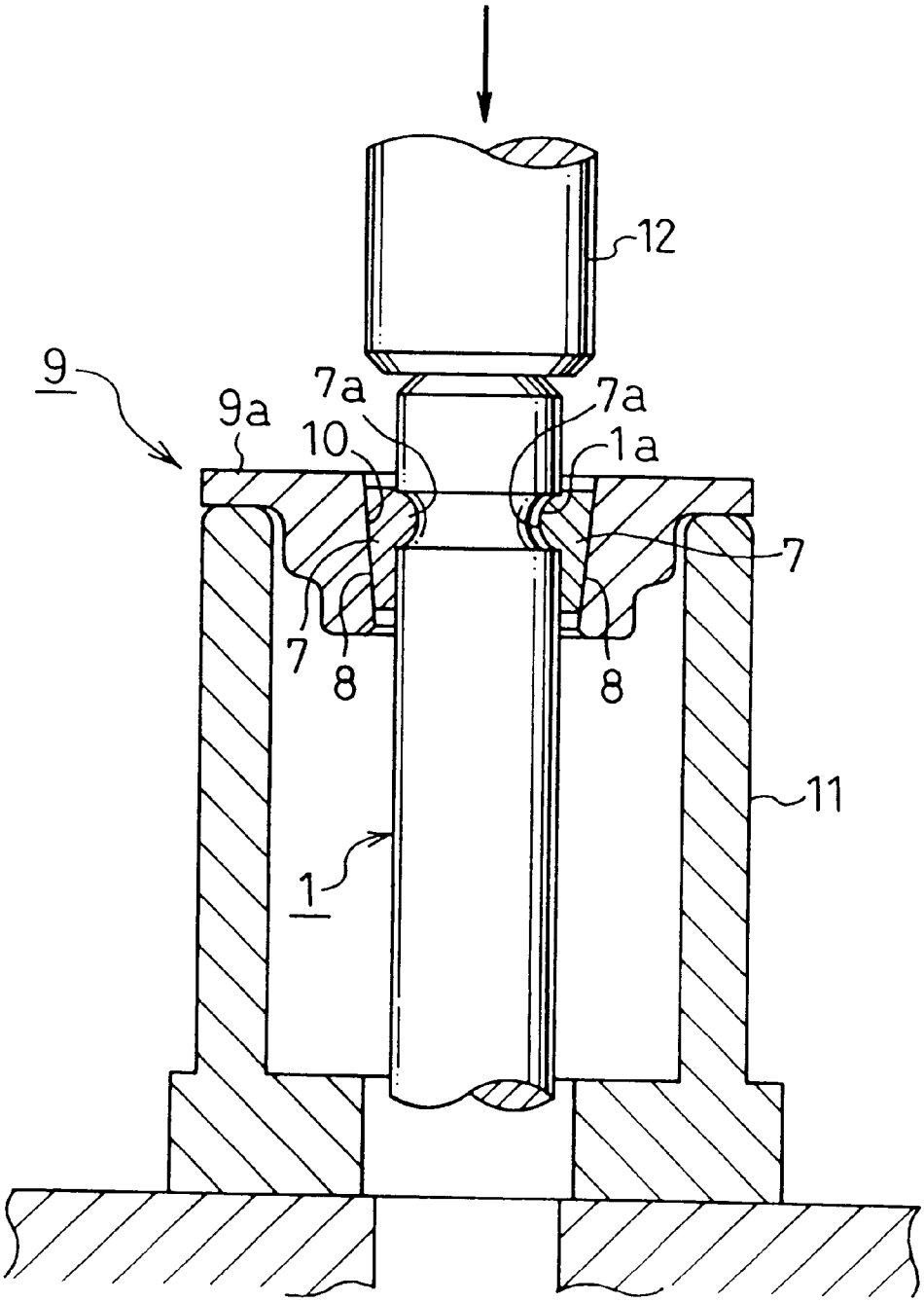
FIG. 3 is a central vertical sectional front view which illustrates how to determine load by which cotters come out of a bore of a valve spring retainer.

The flange 9*a* of the valve spring retainer 9 is supported by a cylindrical jig 11 as shown in FIG. 3, and the poppet valve 1 is pressed at the upper end by a pressing rod 12 of a pressing machine such as a hydraulic cylinder.

Load by which the cotters 7,7 are pressed out of the valve spring retainer 9 is determined. In a conventional valve operating mechanism which includes cotters having flat outer circumferential surface, load is about 9 kN, while load in the present invention is about 15 kN which is equivalent to that a steel valve spring retainer. Increase in load of the cotter would avoid necessity of increase in external diameter of the lower end of the valve spring retainer 9 to increase rigidity, thereby providing miniaturization and lightening of the retainer 9.

The cotter 7 is engaged in the bore 10 by fitting the rough surface 8 into the inner circumferential surface of the bore 10. Even if lubricating oil flows into the bore 10 during running of an engine, frictional force of the contact surface will not be decreased. Thus, if surging occurs in the valve spring 5, the cotter 7 could not come out of the upper portion of the bore 10.

The second embodiment of the present invention will be described.

Figure 4:
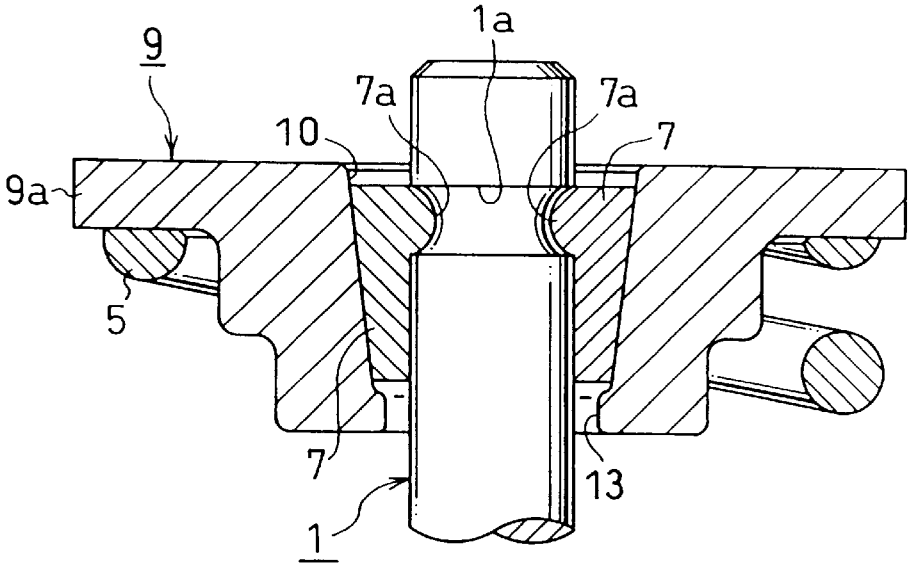
FIG. 4 is a central vertical sectional front view of the second embodiment of a valve operating mechanism of the present invention.

In FIG. 4, an annular projection 13 is formed at the lower portion of a bore 10 of an Al alloy valve spring retainer 9. When a pair of steel cotters 7,7 is engaged in the bore 10 and annular beads 4*a*,4*a* are engaged in an annular groove of a poppet valve 1, the upper end of the annular projection 13 is positioned slightly lower than the lower end of the cotters 7.

In a valve operating mechanism which includes the valve spring retainer 9, load of a valve spring 5 is applied upwards to a spring-retaining flange 9*a* of the valve spring retainer 9 repeatedly, and the cotters 7 slides relatively downwards. The lower end of the cotters 7 contacts the annular projection 13, thereby preventing further downward movement thereof.

Therefore, the cotters 7 are prevented from falling out to decrease preset load of the valve spring 5, so that the maximum rotation number of surging is not decreased.

The annular projection 13 provides high shear strength, pressing load of the cotters 7 to the bore 10, and in ordinary operation, there is no possibility that the cotters 7 would be pressed downwards to break the annular projection 13 to go out of the bore.

Figure 5:
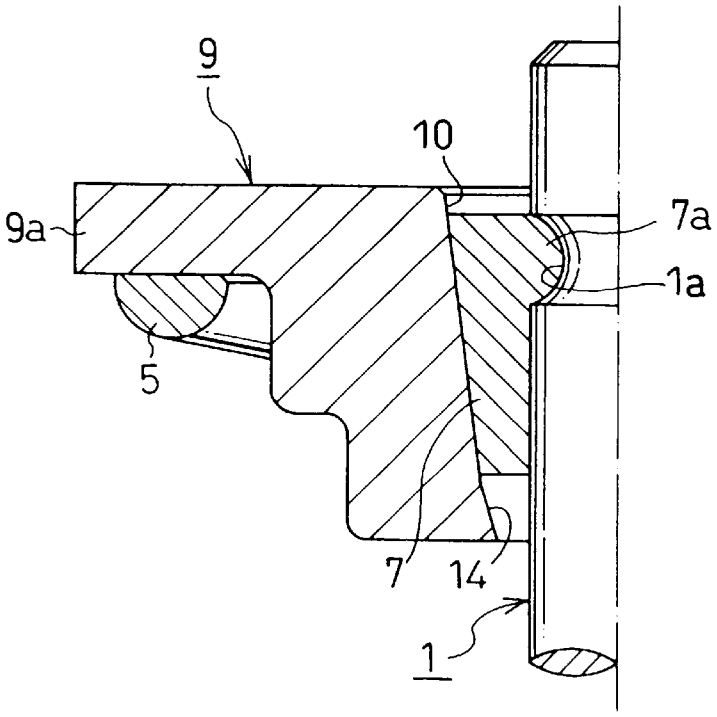
FIG. 5 is a central vertical sectional front view of the third embodiment of a valve operating mechanism of the present invention.
Figure 6:
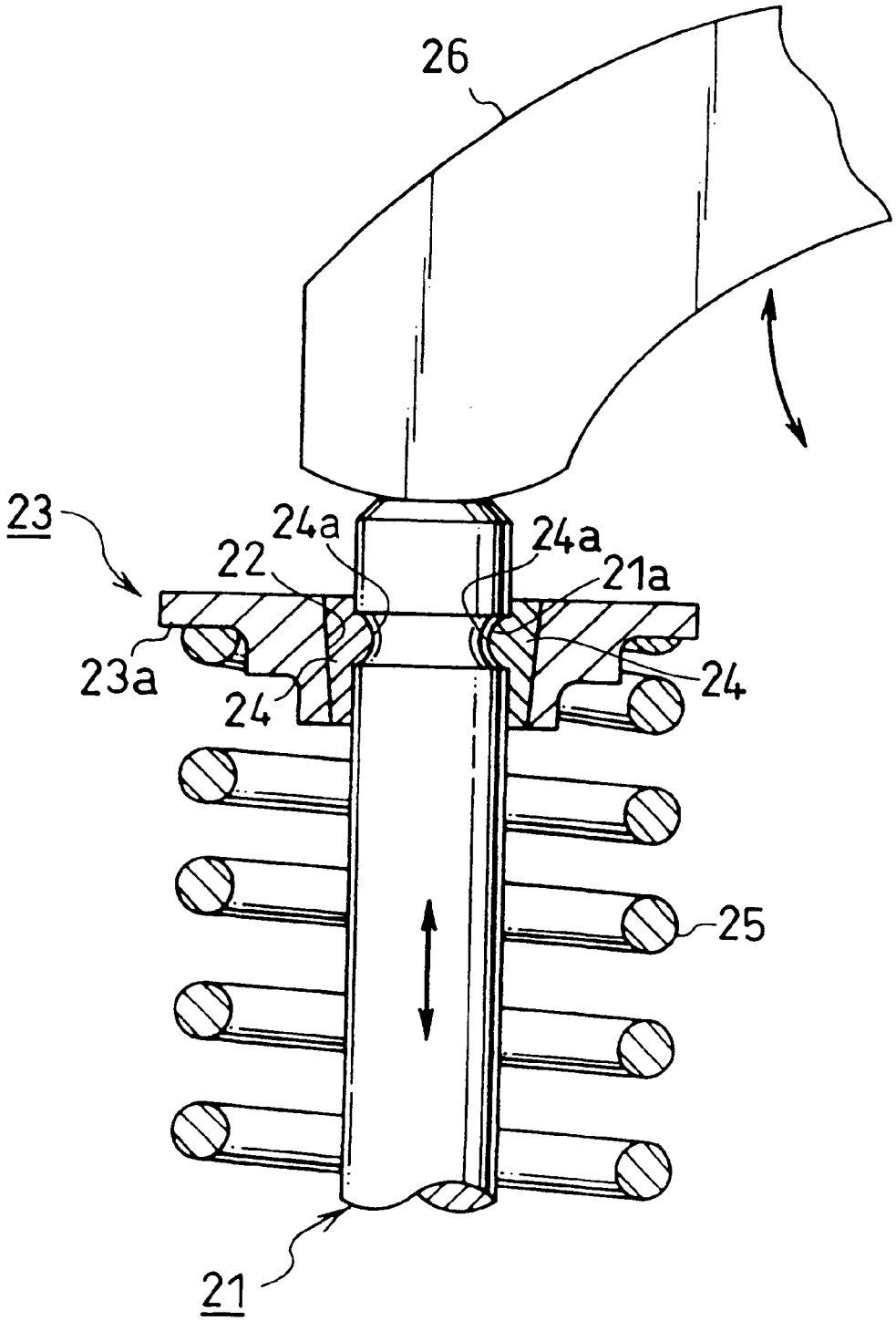
FIG.6 PRIOR ART
FIG. 6 is a central vertical sectional front view of a conventional valve operating mechanism.
Figure 7:
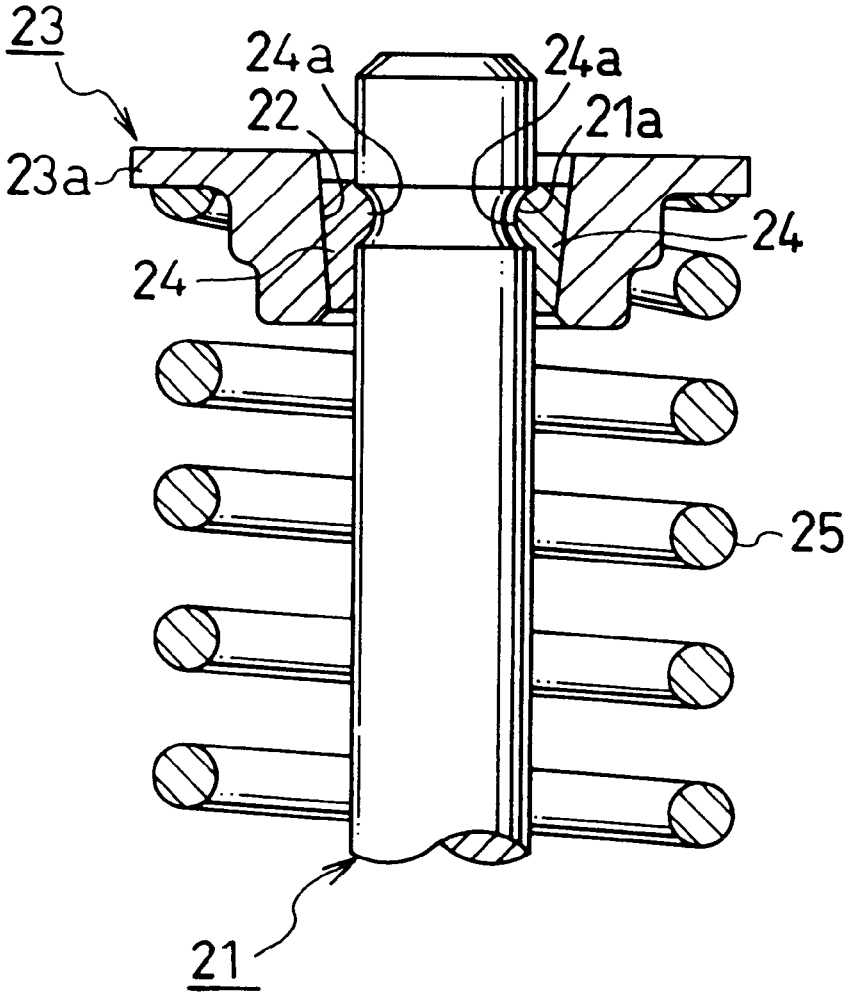
FIG.7 PRIOR ART
FIG. 7 is a central vertical sectional front view thereof in which cotters are fallen.

FIG. 5 is a sectional view of the third embodiment of the present invention in which a smaller diameter portion 14 is formed to have larger taper angle than that of a bore 10, at a lower portion than the lower end of the cotters 7. In the embodiment, the cotters 7 are prevented from falling out, by the smaller diameter portion 14.

The foregoing relate to embodiments of the present invention. Various changes and modifications may be made by person skilled in the art without departing from the scope of claims wherein:

What is claimed is:

1. A valve operating mechanism for a poppet valve of an internal combustion engine, said mechanism comprising:

a light alloy valve spring retainer which has a taper bore;

a pair of cotters which is engaged in the taper bore of the valve spring retainer, each of the cotters having a bead in an inner circumferential surface, said beads being engaged in an annular groove of an end of the poppet valve; and a valve spring provided between said valve spring retainer and a cylinder head, each of the cotters having an outer circumferential rough surface which is engaged in an inner circumferential surface of the bore of the valve spring retainer to prevent the cotters from falling out of the bore of the valve spring retainer.

* * * * *